US007033138B2

(12) United States Patent
Tomita et al.

(10) Patent No.: US 7,033,138 B2
(45) Date of Patent: Apr. 25, 2006

(54) RING SEGMENT OF GAS TURBINE

(75) Inventors: Yasuoki Tomita, Takasago (JP); Osamu Isumi, Takasago (JP); Shinichi Inoue, Nagasaki (JP); Friedrich Soechting, Miami, FL (US); Vincent Laurello, Miami, FL (US); Hiroshige Matsuoka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/235,825

(22) Filed: Sep. 6, 2002

(65) Prior Publication Data

US 2004/0047725 A1 Mar. 11, 2004

(51) Int. Cl.
*F01D 25/08* (2006.01)

(52) U.S. Cl. ..... 415/139; 415/173.1

(58) Field of Classification Search ..... 415/116, 415/139, 173.1, 171.1, 173.4
See application file for complete search history.

(56) References Cited

U.S. PATENT DOCUMENTS 4,318,666 A * 3/1982 Pask ..... 415/116
4,527,385 A * 7/1985 Jumelle et al. ..... 415/116
4,573,865 A * 3/1986 Hsia et al. ..... 415/173.1
4,650,394 A * 3/1987 Weidner ..... 415/116
5,071,313 A * 12/1991 Nichols ..... 415/134
5,088,888 A * 2/1992 Bobo ..... 415/139
5,375,973 A * 12/1994 Sloop et al. ..... 415/173.1
6,126,389 A * 10/2000 Burdgick ..... 415/173.1
6,340,285 B1 * 1/2002 Gonyou et al. ..... 415/116
6,379,528 B1 * 4/2002 Lee et al. ..... 205/640
6,811,373 B1 * 11/2004 Tomita et al. ..... 415/173.1
2001/0005555 A1 * 6/2001 Kreis et al. ..... 415/177

FOREIGN PATENT DOCUMENTS

EP 1033477 A2 * 9/2000
JP 11-247621 9/1999

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

An object of the present invention is to provide a ring segment of a gas turbine in which the temperature is maintained low, damage due to high temperature oxidation is prevented, and high temperature deformation is prevented. In order to achieve the object, the present invention provides a ring segment of a gas turbine which comprises a blade ring, a main shaft and moving blades comprising a plurality of individual units which define an annular form by being arranged around the peripheral direction of the main shaft, and disposed so that its inner peripheral surface is maintained at a constant distance from the tips of the moving blades, wherein grooves which extend along the axial direction of the main shaft of the turbine are formed upon of the individual units so as mutually to confront one another; a seal plate which is inserted into each mutually confronting pair of the grooves so as to connect together the adjacent pair of individual units; and contact surfaces which are formed at positions more radially inward than the seal plates, which extend in the axial direction and the peripheral direction and which mutually contact one another.

4 Claims, 10 Drawing Sheets

RING SEGMENT OF GAS TURBINE

BACKGROUND OF THE INVENTION

1. Field of the Invention

The present invention relates to a ring segment of annular form which is disposed around the outer periphery of the moving blades in a gas turbine.

2. Description of the Related Art

FIG. 8 shows a turbine 1 in section, which is a gas turbine. In this turbine 1, gas at high temperature which has been generated by a combustors (not shown in the figures) is supplied in the direction shown by the arrow 2 and blows against moving blades 3 and 4 so as to rotate the moving blades 3 and 4, and the heat energy in the high temperature gas is converted in this manner to mechanical rotational energy of the moving blades 3 and 4, so as to generate drive power.

The moving blades 3 and 4 are fixed to a mounting platform 5 which is fitted around a main shaft (not shown in the figure). A plurality of these moving blades 3 and 4 are provided around the main shaft, spaced apart along its peripheral direction. They receive the impact of the high temperature gas which flows from the upstream side (the left side in FIG. 8) to the downstream side, and rotate along with the platform 5. Stationary blades 6 and 7 are provided at the upstream sides of the moving blades 3 and 4 respectively. A plurality of these stationary blades 6 and 7 are provided just like the moving blades 3 and 4, they are arranged around the main shaft, spaced apart around its peripheral direction. Furthermore, ring segments 8 are provided around the outer peripheries of the moving blades 3 and 4, with almost constant gaps f being present between these ring segments 8 and the moving blades 3 and 4. The ring segments 8 compose a plurality of individual units 8*a* (refer to FIG. 10) which are made out of cobalt alloy.

FIG. 9 is a cross sectional view showing one of the moving blades 3 of the turbine 1 and the vicinity of its peripheral portion including one of the ring segments 8. As shown in FIG. 9, a flow conduit 11 is formed through the blade ring 9 so as to open towards the ring segment 8. Furthermore, isolating rings 10 are fitted in the blade ring 9. Air, which is injected either from an air supply source provided externally to the turbine 1 or from a compressor (not shown in the figure), flows into this flow conduit 11 in the direction shown by the arrow 12. An impingement plate 13 and the ring segment 8 are fixed to the isolating rings 10. The impingement plate 13 is provided between the blade ring 9 and the ring segment 8, and it is provided around its circumferential surface with a plurality of cooling apertures 14 for conducting air which is ejected from the flow conduit 11. The ring segment 8 has two flanges 16 upon its outer peripheral surface 15, one at its upstream side and one at its downstream side, and the ring segment 8 is fixed to the isolating rings 10 via these flanges 16. A plurality of cooling conduits 17 are provided to the ring segment 8, each being pierced through the inner portion of the ring segment 8 from the upstream side of its outer peripheral surface 15 to its end surface in the downstream direction.

FIG. 10 is a perspective view of the individual units 8*a* which make up the ring segment 8. As shown in FIG. 10, each of the flanges 16 extends around the peripheral direction. A roughly rectangular concave portion 19 is provided upon the outer peripheral surface 15 between these flanges 16. A plurality of opening aperture portions 17*a* of the cooling conduits 17 are provided at the upstream side of this concave portion 19, arranged along the peripheral direction.

Furthermore, grooves 21 are formed at each of the side edges 20 of this individual unit 8*a*, so as to face the adjacent individual units 8*a*. The impingement plate 13 is arranged around the outer circumferential side of the individual units 8*a*. A cavity 22 is defined by this impingement plate 13 and the concave portion 19 of the individual unit 8*a*.

FIG. 11 is a cross sectional view of prior art ring segment 8 as seen from the axial direction of the main shaft. As shown in FIG. 11, adjacent individual units 8*a* are linked in the peripheral direction by a seal plate 23 being inserted into both the two grooves 21 which are formed in their mutually confronting side edges 20, so that collectively the individual units 8*a* constitute an annular ring segment 8. These seal plates 23, along with joining each adjacent pair of individual units 8*a* together, also serve to prevent the leakage of air and high temperature gas through the gaps between the adjacent pairs of individual units 8*a*. The thickness of the thin plate portion of each of the individual units 8*a* is approximately 6 mm. By this thickness of the thin plate portion of each of the individual units 8*a* is meant the distance (shown in the figure by the symbol d) from the bottom surface of its concave portion 19 to the surface 24 on the other side of the individual unit 8*a*, which surfaces 24, in cooperation, define the inner peripheral surface 24 of the ring segment 8.

When the turbine is operating, each of the individual units 8*a* expands both in the peripheral direction and in the axial direction, due to exposure to the influence of the flow of high temperature gas. In consideration of the amount of dimensional variation of the individual units 8*a* due to thermal expansion in the peripheral direction, a gap e of a few millimeters is provided between each of the individual units 8*a* and the adjacent one.

Next, the flow of high temperature air and gas during operation of the gas turbine will be explained.

The high temperature gas flows along the direction of the axis of the main shaft as shown by the symbol 2 in FIGS. 8 through 10 and drives each of the moving blades 3 and 4. Furthermore, air is blown and passes through the blade ring 9 for cooling each of the individual units 8*a* of the ring segment 8. This air flows in the direction shown by the arrow A in FIGS. 9 and 10, and flows into each of the cavities 22 through those of the cooling holes 14 in the impingement plate 13. This air which has flowed into the cavity 22, after having collided with the concave portion 19 and having thereby cooled the ring segment 8, flows in the direction shown by the arrow B, and enters through the opening aperture portions 17*a* into the cooling conduits 17. And this air which has entered into the cooling conduits 17 flows to the downstream side through the cooling conduits 17 while further cooling the inside of the ring segment 8, finally being ejected from the downstream ends of the cooling conduits 17 into a high temperature gas.

Moreover, this air is blown out at a higher pressure than that of the high temperature gas, in order for none of this high temperature gas to flow into the downstream ends of the cooling conduits 17. When in this manner the air is blown out at a higher pressure than that of the high temperature gas, the seal plate 23 is pressed against the lower surface 25 of the grooves 21 by the pressure difference between the air and the high pressure gas, and thereby the sealing efficiency of the ring segment 8 is enhanced. Due to this, loss of driving power of the gas turbine due to leakage of air and high temperature gas is prevented. However, when the air is thus blown out at a suitable pressure, the high temperature gas intrudes between the seal plates 23 and the grooves 21 from the gaps e between the adjacent pairs of individual units 8*a*, and the corner edge portions 26 which are delimited between the inner peripheral surfaces 24 and the side edges 20 are each heated up from three sides: the inner peripheral surface 24, the side edge 20, and lower surface 25 of the groove 21. These heated up corner edge portions 26 reach high temperatures locally, and undesirably suffer deterioration due to the occurrence of high temperature oxidation. Furthermore, even if the air is blown out at a suitable pressure, since the corner edge portions 26 are heated up by the high temperature gas which is flowing along the inner peripheral surface 24 and also by the high temperature gas which insinuates into the gaps e between adjacent ones of the individual units 8*a*, accordingly they can easily suffer high temperature oxidation, and there is a danger that they may be damaged. Yet further, in some cases, the seal plates 23 suffer temperature deformation as well, due to their lower surfaces being directly exposed to the high temperature gas.

If the corner edge portion 26 or the seal plate 23 suffers injury or damage, a large quantity of air will flow out into the high temperature gas side from the corresponding gap e between the adjacent individual units 8*a*. Furthermore, if the air is no longer being sucked out at a suitable pressure, the high temperature gas may flow out to the outer peripheral side of the ring segment 8 via the gap e. If the high temperature gas or the air leaks in this manner, the gas turbine will suffer an undesirable loss of driving power, and its operational performance will be deteriorated.

Furthermore, with the above described ring segment 8, although the thermal expansion of the individual units 8*a* in the peripheral direction is approximately absorbed by the gaps e, their thermal expansion in the axial direction is not absorbed, due to each of the flanges 16 being fitted to the blade ring 9 with no gap therebetween, and the peripheral surface of the ring segment 8 between the flanges 16 may suffer warping and may collide with the moving blades 3 and 4.

The present invention has been made in consideration of the above described circumstances, and an object of the present invention is to provide a ring segment for a gas turbine, which is sufficiently well cooled by the flow of air, and which moreover can prevent loss of driving power of the gas turbine.

SUMMARY OF THE INVENTION

In order to achieve the above described objective, the present invention provides a ring segment of a gas turbine which comprises a blade ring, a main shaft and moving blades, comprising a plurality of individual units which define an annular form by being arranged around the peripheral direction of the main shaft, and disposed so that its inner peripheral surface is maintained at a constant distance from the tips of the moving blades, wherein the individual unit comprises grooves which extend along the axial direction of the main shaft, and each of which faces to a groove formed in the other individual unit; a seal plate for connecting together the adjacent pair of individual units which is inserted into the groove; and a contact surface which is formed at position more radially inward than the seal plate, which contacts another contact surface of the other individual unit in the axial direction and the peripheral direction of the main shaft.

In the ring segment, leakage of air from damaged locations upon the seal plate is made difficult, because the lower surface of the seal plate is not directly exposed to the high temperature gas, and thus damage does not occur to the seal plate. Furthermore, since adjacent ones of the individual units are joined together into pairs by the seal plates and the joining together contact surfaces, and also meandering conduits are defined between the adjacent ones of the individual units, thereby the flow rate of leakage of air and high temperature gas between adjacent ones of the individual units is reduced. Accordingly, it is possible to prevent loss of driving power of the gas turbine due to leakage of air and high temperature gas.

In addition, in order to achieve the object, the present invention provide another ring segment of a gas turbine which comprises a blade ring, a main shaft and moving blades, comprising a plurality of individual units which define an annular form by being arranged around the peripheral direction of the main shaft, and disposed so that its inner peripheral surface is maintained at a constant distance from the tips of the moving blades, wherein the individual units comprises ejection apertures for blowing out air to the adjacent individual units.

In the ring segment, since the high temperature gas is flushed out from between the adjacent pairs of individual units by the air which is ejected from the ejection apertures, thereby heating up of the side edges of the individual units is effectively suppressed, and it is difficult for damage to occur to the side edges due to high temperature oxidation. Accordingly, the flow rate of the air and high temperature gas leaking through the gaps between the adjacent individual units is reduced. Due to this, it is possible to reduce the loss of driving power of the gas turbine.

In the ring segment, it is preferable that ejection apertures upon each adjacent pair of the individual units are formed at positions which alternate along the axial direction of the main shaft.

In the ring segment, it is possible reliably to guarantee that the high temperature gas is properly flushed out from between the adjacent individual units, since the air streams which are ejected from the various ejection apertures do not collide with one another, and accordingly the air is smoothly injected.

In addition, in order to achieve the object, the present invention provide another ring segment of a gas turbine which comprises a blade ring, a main shaft and moving blades, comprising a plurality of individual units which define an annular form by being arranged around the peripheral direction of the main shaft, and disposed so that its inner peripheral surface is maintained at a constant distance from the tips of the moving blades, wherein the individual unit comprises beveled portions between its side edges which face the adjacent ones of the individual units and its inner peripheral surface.

In the ring segment, the temperature of the metal is moderated, since the convection cooling effect around the edges (corner portions), i.e. from the side edges to the inner peripheral surface, is no longer small. Accordingly it becomes difficult for the edge portions to suffer damage due to the occurrence of high temperature oxidation.

In addition, in order to achieve the object, the present invention provide another ring segment of a gas turbine which comprises a blade ring, a main shaft and moving blades, comprising a plurality of individual units which define an annular form by being arranged around the peripheral direction of the main shaft, and disposed so that its inner peripheral surface is maintained at a constant distance from the tips of the moving blades, wherein, the individual unit comprises: first cooling conduits which are pierced from the outer peripheral surface to the end surface of the individual unit along the axial direction of the main shaft, and which cool the individual unit by supplying air from the outer peripheral surface; and second cooling conduits which are pierced from the outer peripheral surface to the other end surface opposite the end surface in which the first cooling conduits, and which cool the individual unit by supplying air from the outer peripheral surface.

In the ring segment, the ring segment is cooled from both sides along the axial direction by the flow of air in these first and second cooling conduits. Furthermore, since it is arranged for the air which has blown against the outer peripheral surface to flow over the outer peripheral surface both to the upstream side and also to the downstream side, thereby the exchange of heat between the air and the outer peripheral surface is improved, and the outer peripheral surface of the cooling ring is efficiently cooled. Accordingly, the temperature gradient in the material of the ring segment is made more gentle, and thereby distortion of the ring segment due to thermal deformation thereof is reduced. Due to this, it is possible to prevent contact occurring between the ring segment and the moving blades of the gas turbine.

In addition, in order to achieve the object, the present invention provide another ring segment of a gas turbine which comprises a blade ring, a main shaft and moving blades, comprising a plurality of individual units which define an annular form by being arranged around the peripheral direction of the main shaft, and disposed so that its inner peripheral surface is maintained at a constant distance from the tips of the moving blades, wherein the individual unit comprises third cooling conduits which are pierced from the outer peripheral surface to the side edges which face the adjacent individual unit, and which cool the individual unit by supplying air from the outer peripheral surface.

In the ring segment of a gas turbine, the difference in temperature between the side edges and the outer peripheral surface of the ring segment becomes small, and distortion of the ring segment is reduced, since the side edges of each individual unit are cooled by the air which is passing through the third cooling conduits. Due to this, it is possible to prevent contact occurring between the ring segment and the moving blades of the gas turbine. Moreover the temperature of the side edges is kept low, since the high temperature gas between the individual units is flushed out by the air which is expelled from the side edges of the individual units. Accordingly it becomes difficult for damage caused by high temperature oxidation to take place upon the edge portions between the side edges and the inner peripheral surface, and the flow amount of air and high temperature gas which leaks through between each pair of adjacent individual units becomes small. Due to this, it is possible to reduce loss of driving power of the gas turbine.

In addition, in order to achieve the object, the present invention provide another ring segment of a gas turbine which comprises a blade ring, a main shaft and moving blades, comprising a plurality of individual units which define an annular form by being arranged around the peripheral direction of the main shaft, and disposed so that its inner peripheral surface is maintained at a constant distance from the tips of the moving blades, wherein the individual unit comprises least two of: the grooves which extend along the axial direction of the main shaft, and each of which faces to a groove formed in the other individual unit; the seal plate for connecting together the adjacent pair of individual units which is inserted into the groove; the contact surface which is formed at position more radially inward than the seal plate, which contacts another contact surface of the other individual unit in the axial direction and the peripheral direction of the main shaft; the ejection apertures for blowing out air to the adjacent individual units; the ejection apertures which are upon each adjacent pair of the individual units at positions which alternate along the axial direction of the main shaft; the beveled portions between its side edges which face the adjacent ones of the individual units and its inner peripheral surface; the first cooling conduits which are pierced from the outer peripheral surface to the end surface of the individual unit along the axial direction of the main shaft, and which cool the individual unit by supplying air from the outer peripheral surface; the second cooling conduits which are pierced from the outer peripheral surface to the other end surface opposite the end surface in which the first cooling conduits, and which cool the individual unit by supplying air from the outer peripheral surface; and the third cooling conduits which are pierced from the outer peripheral surface to the side edges which face the adjacent individual unit, and which cool the individual unit by supplying air from the outer peripheral surface.

In the ring segment of a gas turbine, distortion of the ring segment is further reduced, since at least two of the features present in the ring segments as above are present and exert their effects as described. Accordingly, the occurrence of contact between the ring segment and the moving blades of the gas turbine is prevented. Furthermore, it is possible to reduce loss of driving power of the gas turbine, since the leakage amount of air and high temperature gas becomes small.

In the ring segment of a gas turbine, it is preferable for a gap between the individual units to be greater than zero and less than or equal to 1 mm when the gas turbine is operating nominally.

In the ring segment of a gas turbine, heating up of the side edges of the individual units is suppressed, since the flow amounts of the high temperature gas flows which insinuate themselves into the gaps which appear between each pair of adjacent individual units become small, and thereby it becomes difficult for damage to take place to the edge portions between the side edges and the inner peripheral surface due to high temperature oxidation. Accordingly, the flow amount of air and high temperature gas which leaks from the gaps between the individual units becomes small. Due to this, it is possible to reduce loss of driving power of the gas turbine.

In the ring segment of a gas turbine, it is preferable for the thickness of the body of each of the individual units to be greater than or equal to 1 mm and less than or equal to 4 mm.

In the ring segment of a gas turbine, the amount of distortion due to the difference in the amount of thermal deformation between the inner peripheral surface and the outer peripheral surface of the ring segment becomes small, since the temperature difference between the inner peripheral surface and the outer peripheral surface of the ring segment becomes small. Due to this, it is possible to prevent the occurrence of contact between the ring segment and the moving blades of the gas turbine.

In the ring segment of a gas turbine, it is preferable that the individual unit comprises projections formed upon the outer peripheral surface thereof.

In the ring segment of a gas turbine, the heating surface area upon the outer peripheral surface of the individual units is increased due to the provision of these projections upon the outer peripheral surface, so that the heat exchange between the individual units and the air flow across them is performed efficiently. Furthermore, the heat exchange between the air and the outer peripheral surface is improved, because the air flow upon the outer peripheral surface is made more turbulent by these projections. Accordingly the temperature of the ring segment is moderated, and the amount of thermal deformation of the ring segment is made smaller, so that distortion of the thermal ring is reduced. Due to this, it is possible to prevent the occurrence of contact between the ring segment and the moving blades of the gas turbine.

In the ring segment of a gas turbine, it is preferable that the individual unit further comprises flanges for being fitted to the blade ring, and the flange comprises a plurality of slits which are formed so as to extend along the axial direction of the main shaft.

In the ring segment of a gas turbine, it is preferable that the individual unit further comprises strengthening ribs which are provided upon the outer peripheral surface thereof.

In the ring segment of a gas turbine, thermal deformation of the ring segment is alleviated, since the strength of each of the individual units is increased by the provision of these strengthening ribs. Due to this, it is possible to prevent the occurrence of contact between the ring segment and the moving blades of the gas turbine.

In the ring segment of a gas turbine, it is preferable that the individual unit is made from nickel alloy.

In the ring segment of a gas turbine, since the ring segment is made from nickel alloy, not only is the fatigue strength of the ring segment enhanced, but also high temperature oxidation of the ring segment is impeded. Accordingly, damage to the ring segment due to high temperature oxidation is prevented, and the flow amount of working fluid which leaks to the outside, and the flow amount of air which leaks to the inside, are both reduced. Due to this, it is possible to prevent loss of driving power of the gas turbine.

DESCRIPTION OF THE PREFERRED EMBODIMENT

In the following, the preferred embodiment of the ring segment of a gas turbine according to the present invention will be explained with reference to FIGS. 1 through 7. It should be understood that to elements which are the same as elements of the prior art described above with reference to FIGS. 8 through 11, the same reference symbols are affixed as in those figures, and the explanation thereof will be curtailed.

Figure 1:
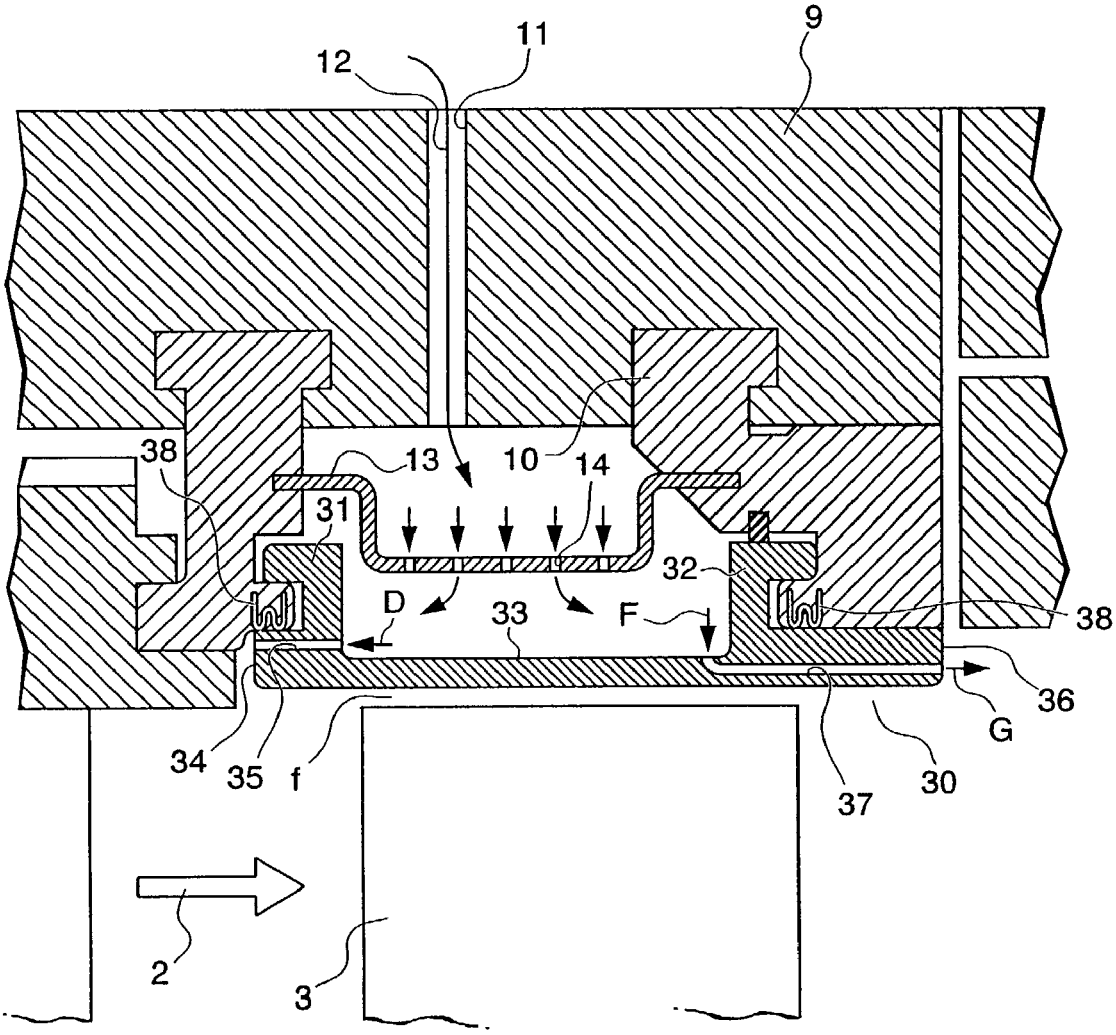
FIG. 1 is a cross sectional view of a ring segment of a gas turbine according to the preferred embodiment of the present invention, as seen from the direction transverse to the axis of the main shaft of the gas turbine.

FIG. 1 is a cross sectional view of a ring segment 30 of a gas turbine according to the preferred embodiment of the present invention. This ring segment 30 is made from nickel alloy. The ring segment 30 is attached to isolating rings 10 by a flange 31 which is provided on the upstream side in the flow direction of high temperature gas and a flange 32 which is provided upon the downstream side. To the ring segment 30 there are provided first cooling conduits 35 which are pierced from the outer peripheral surface 33 at its upstream side to its end surface 34 at its upstream side, and second cooling conduits 37 which are pierced from the outer peripheral surface 33 at its downstream side to its end surface 36 at its downstream side. Air which has flowed into the first cooling conduits 35 from the outer peripheral surface 33 flows towards the upstream direction and is ejected from the end surface 34 at its upstream side into the high temperature gas. And air which has flowed into the second cooling conduits 37 from the outer peripheral surface 33 flows towards the downstream direction and is ejected from the end surface 36 at its downstream side.

Furthermore, two seal members 38 having "E" shapes as seen in cross section are provided between the ring segment 30 and the isolating rings 10, one at the upstream side and one at the downstream side. These seal members 38 are for preventing the leakage of high temperature gas and air from between the ring segment 30 and the isolating rings 10.

Figure 2:
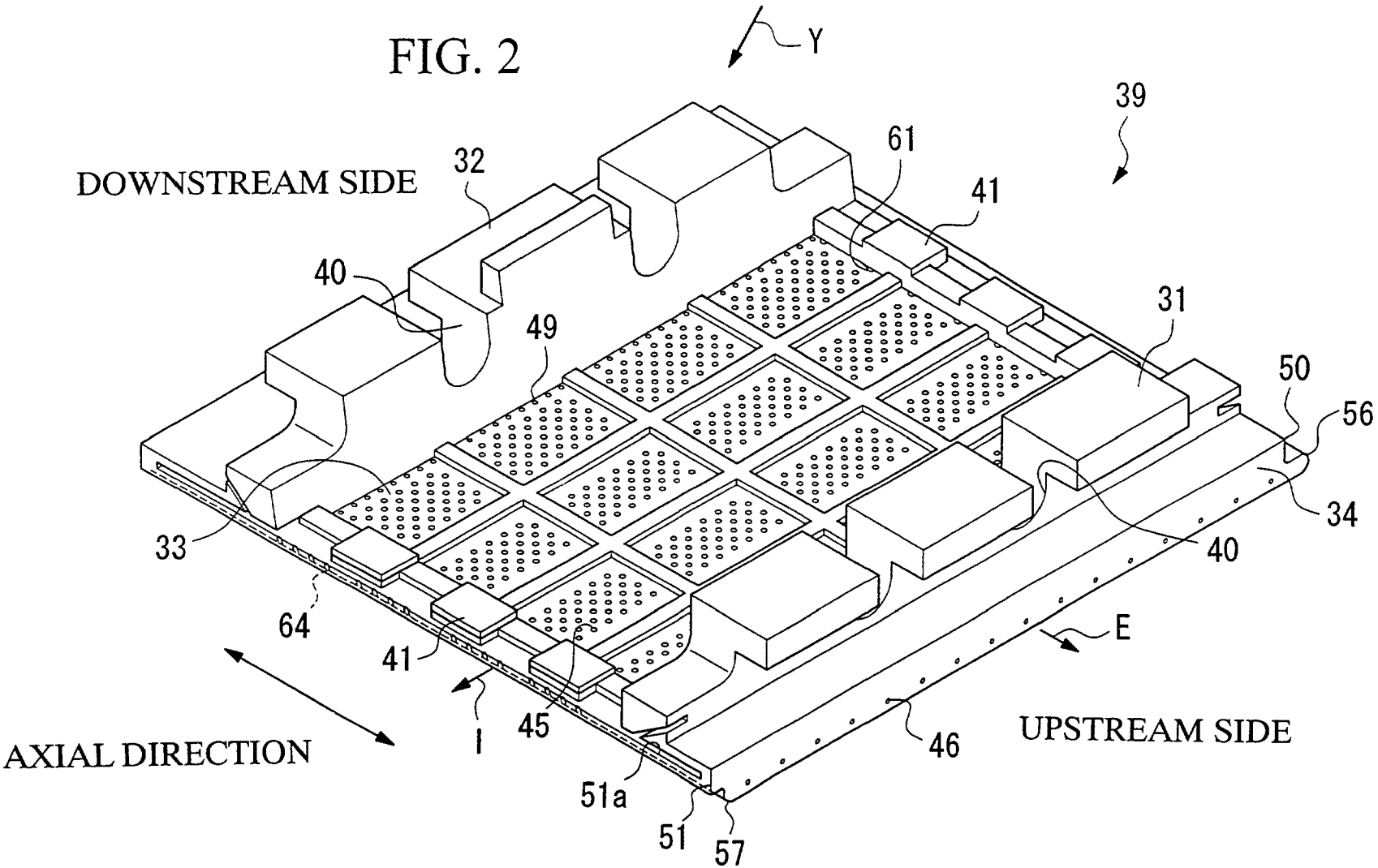
FIG. 2 is a perspective view of one of a number of individual units which together make up the ring segment of a gas turbine according to the preferred embodiment of the present invention of FIG. 1.

FIG. 2 is a perspective view showing one of the individual units 39 which make up the ring segment 30. In FIG. 2, the right front side is the upstream side with respect to the flow of high temperature gas, while the left rear side is the downstream side. And FIG. 3 is a perspective view of the same individual unit 39 as seen from the opposite corner (i.e., from the corner shown by the arrow Y in FIG. 2), and in this figure the left rear side is the upstream side with respect to the flow of high temperature gas, while the right front side is the downstream side.

Figure 3:
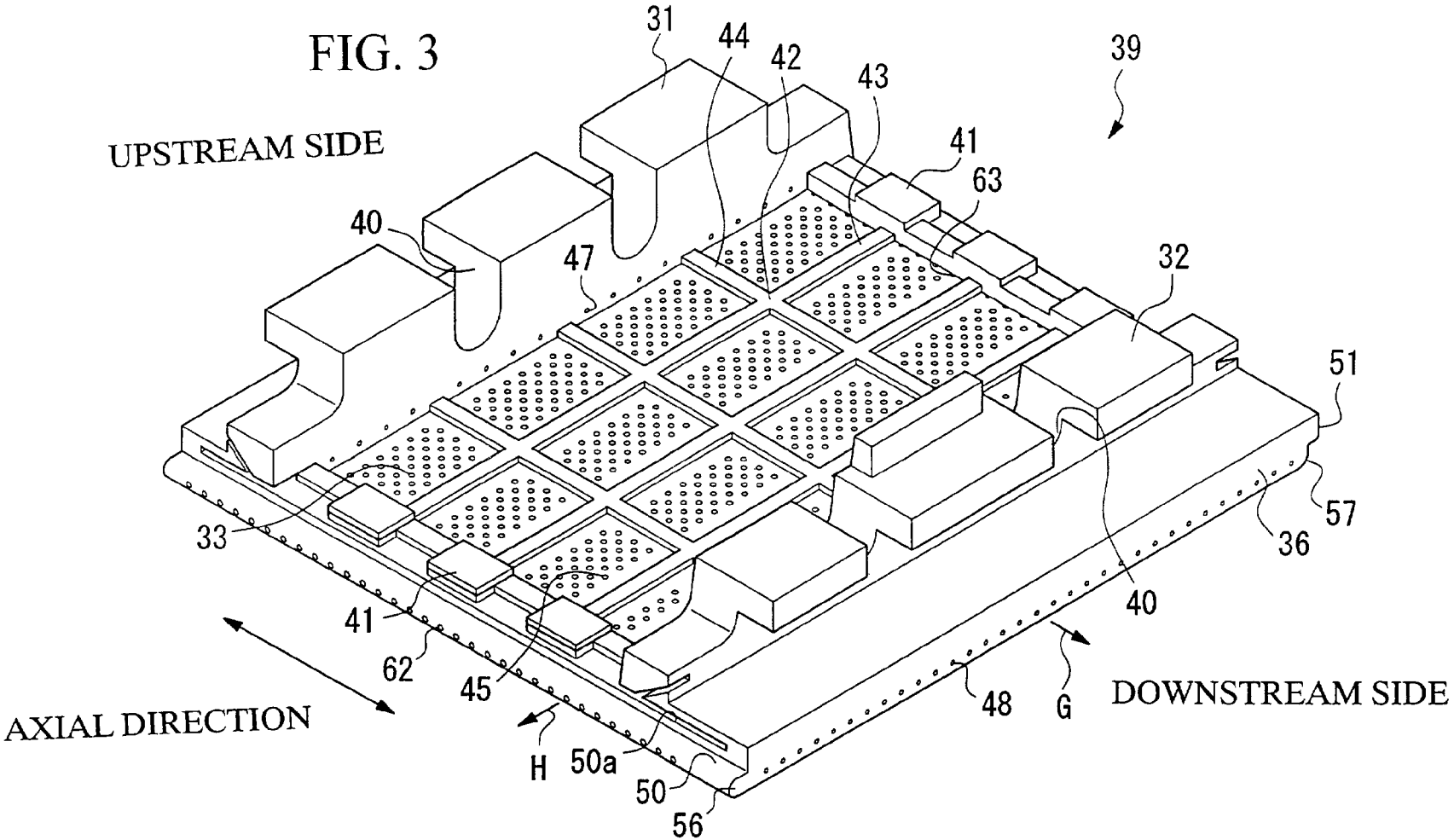
FIG. 3 is another perspective view of this individual unit which is incorporated in this ring segment of a gas turbine according to the preferred embodiment of the present invention, as seen from the corner opposite to that from which the FIG. 2 view is taken.

As shown in FIGS. 2 and 3, "U" shaped slits 40 which extend along the axial direction are formed at the flanges 31 and 32. Furthermore, the ends of the U shaped slits 40 in the peripheral direction are almost the same height as the flanges 31 and 32. Convex portions 41 which extend along the axial direction are formed upon the outer peripheral surface 33 of the individual unit 39, so as to connect together the ends of the mutually opposing flanges 31 and 32. Strengthening ribs 42 in the form of a lattice are provided upon the outer peripheral surface 33 so as to be surrounded by these convex portions 41 and the flanges 31 and 32. These strengthening ribs 42 consist, in the shown preferred embodiment of the present invention, of three peripherally extending ribs 43 which extend in the peripheral direction, and three axially extending ribs 44 which extend in the axial direction. Furthermore, a large number of small projections 45 are provided upon the outer peripheral surface 33, so as to be surrounded by the convex portions 41 and the flanges 31 and 32. These serve to increase the heating surface area of the outer peripheral surface 33.

The symbol 46 in FIG. 2 denotes an ejection aperture of one of the first cooling conduits 35 which open to the end surface 34 on the upstream side. A plurality of these ejection apertures 46 are provided upon the end surface 34 on the upstream side, spaced apart from one another at equal intervals along the peripheral direction. Moreover, as shown in FIG. 3, a plurality of sucking in apertures 47 of these first cooling conduits 35 are provided, located at the lower portion of the wall surface facing to the downstream side of the flange 31 on the upstream side, and they too are spaced apart from one another at equal intervals along the peripheral direction. Similarly, as also shown in FIG. 3, a plurality of ejection apertures 48 of the second cooling conduits 37 are provided upon the end surface 36 on the downstream side, spaced apart from one another at equal intervals along the peripheral direction. Moreover, as shown in FIG. 2, a plurality of sucking in apertures 49 of these second cooling conduits 37 are provided, located upon the downstream side of the outer peripheral surface 33 near the lower portion of the wall surface facing to the upstream side of the flange 32 on the downstream side, and they too are spaced apart from one another at equal intervals along the peripheral direction.

Grooves 50*a* and 51*a* which extend along the axial direction are formed upon the side edges 50 and 51 of each of the individual units 39 facing towards the adjacent individual units 39. A seal plate 53 (refer to FIG. 4) is inserted into the grooves 50*a* and 51*a* of each adjacent pair of individual units 39 so as to connect them together and seal between them.

As shown in FIGS. 2 and 3, the side edges 50 and 51 of each of the individual units 39 are formed differently from one another. When the individual units 39 are joined together in the peripheral direction, at each of the junctions between two adjacent individual units 39, the side edge 50 of the one unit engages with the side edge 51 of the other unit.

Figure 4:
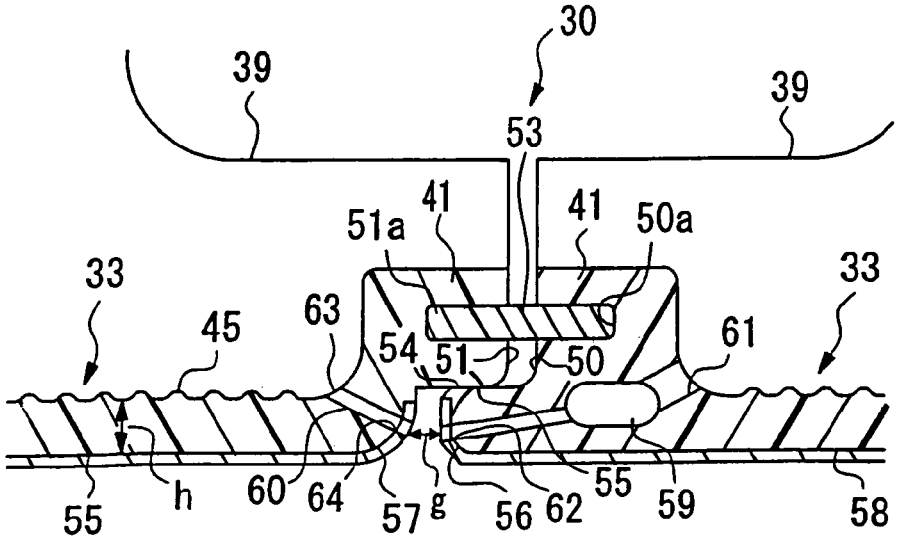
FIG. 4 is a cross sectional view of the joining portion between two of these individual units of FIGS. 1 through 3 which are adjacent to one another, as seen from the direction along the axis of the main shaft of the gas turbine.

FIG. 4 is a cross sectional view showing the joining portion between two of the individual units 39 which are adjacent to one another, as seen along the axial direction of the main shaft of the gas turbine. As shown in this figure, the groove 50*a* which is formed upon the one side edge 50 and the groove 51*a* which is formed upon the other side edge 51 are formed so as mutually to confront one another. And the seal plate 53 is inserted into these grooves 50*a* and 51*a* and joins the two individual units 39 together while sealing the gap between them. The side of the side edge 51 of the one individual unit 39 inward of the seal plate 53 (i.e., on the side thereof towards the main shaft of the gas turbine) is formed to be convex so as to project outwards towards the side edge 50 of the other individual unit 39. Conversely, the side of the side edge 50 of the other individual unit 39 inward of the seal plate 53 is formed to be concave, so as to receive the convex portion of the side edge 51. And contact surfaces 54 and 55, more radially inwards than the seal plate 53, are defined upon the adjacent individual units 39, with these contact surfaces 54 and 55, when the convex side edge 51 and the neighboring concave side edge 50 are thus fitted together, mutually contacting one another over a certain extent both in the axial direction and also in the peripheral direction.

Respective beveled portions 56 and 57 are formed between the side edge 50 and the inner peripheral surface 55, and between the side edge 51 and the inner peripheral surface 55. The thickness h of each of the individual units 39 from its outer peripheral surface 33 (not counting the projections 45) to its inner peripheral surface 55 (i.e., the thickness of its body portion between the flanges 31 and 32) is approximately a few millimeters. Specifically, the thickness of the body of each of the individual units is greater than or equal to 1 mm and less than or equal to 4 mm. A heat shielding coating (hereinafter termed a TBC—"Thermal Barrier Coating") 58 is provided upon the inner peripheral surface 55 and upon the beveled portions 56 and 57. This TBC 58 protects the inner peripheral surface 55 and the beveled portions 56 and 57 from the high temperature gas, and operates to protect these parts from high temperature oxidation.

Figure 5A:
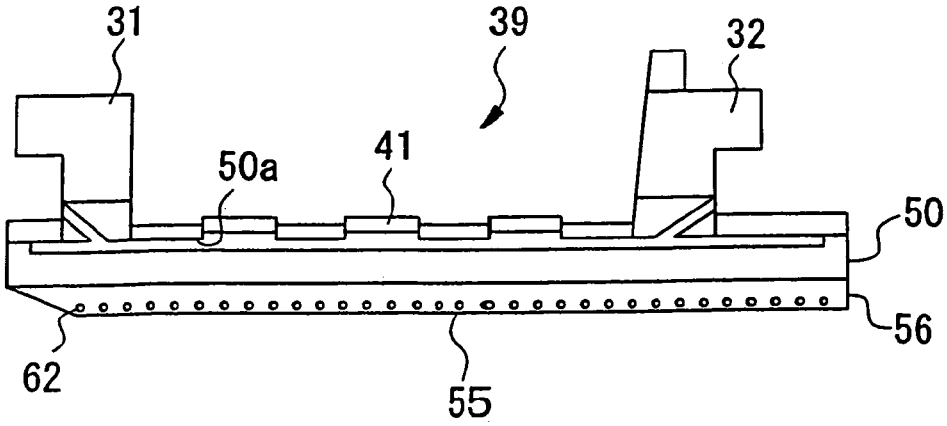
FIGS. 5A and 5B are both side views of this individual unit which is incorporated in the ring segment of a gas turbine according to the preferred embodiment of the present invention.
Figure 5B:
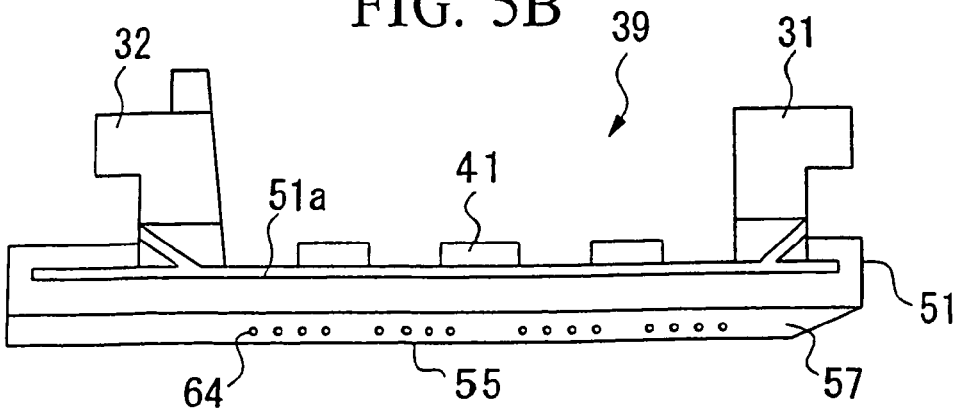

Third cooling conduits 59 and 60 are provided to the individual units 39, and these respectively pierce through the beveled portions 56 and 57 from the outer peripheral surface 33. The sucking in apertures 61 of the third cooling conduits 59 which are formed at the one side edge 50 are provided along the boundary between the outer peripheral surface 33 and the convex portion 41 on the side of the side edge 50, as shown in FIG. 2, while their ejection apertures 62 are provided spaced apart from one another at equal intervals in the axial direction of the main shaft, as shown in FIGS. 3 and 5A. The cooling air which is ejected from these ejection apertures 62 is blown out against the opposing beveled portion 57 of the adjacent individual unit 39. And the sucking in apertures 63 of the third cooling conduits 60 which are formed at the other side edge 51 are provided along the boundary between the outer peripheral surface 33 and the convex portion 41 on the side of the side edge 51, as shown in FIG. 3, while their ejection apertures 64 are provided spaced apart from one another at equal intervals in the axial direction of the main shaft, as shown in FIGS. 3 and 5B. The cooling air which is ejected from these ejection apertures 64 is blown out against the opposing beveled portion 56 of the adjacent individual unit 39.

A gap between the individual units, that is a gap between these ejection apertures 62 and 64 is greater than zero and less than or equal to 1 mm when the gas turbine is operating nominally.

Figure 6:
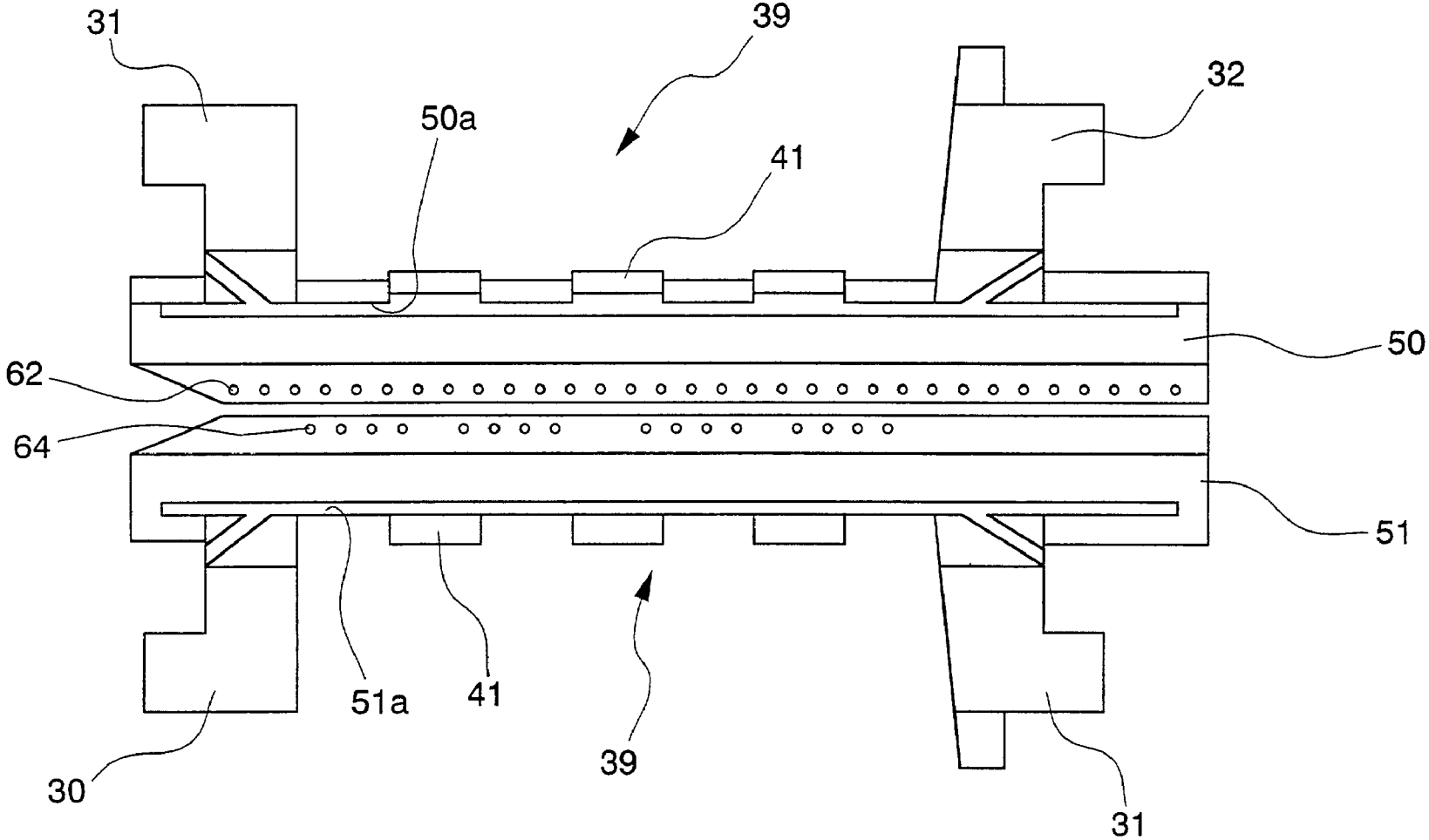
FIG. 6 is a side view of this individual unit which is incorporated in the ring segment of a gas turbine according to the preferred embodiment of the present invention.

Furthermore, as shown in FIG. 6, the ejection apertures 62 and 64 are formed so as, when the side edge 50 and the side edge 51 are mutually engaged together, to be alternately mutually spaced apart from one another in the axial direction. When this is done, the air streams which are ejected from each of the ejection apertures 62 and 64 do not collide together, so that the air is smoothly ejected.

Moreover, holes are formed in the TBC which is provided upon the beveled portions 56 and 57 at the portions where the apertures 62 and 64 are located.

Figure 7:
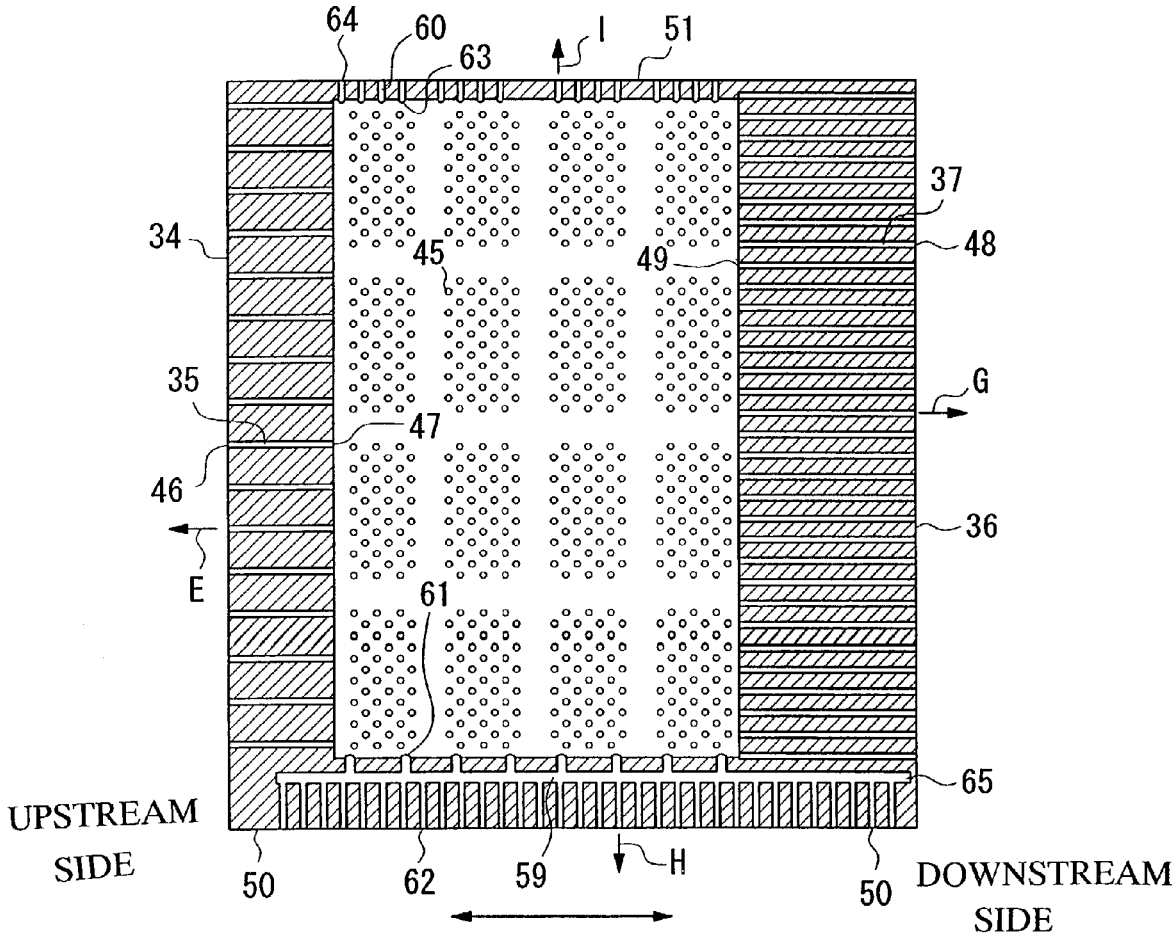
FIG. 7 is a cross sectional view along the direction of formation of cooling conduits formed in this individual unit which is incorporated in the ring segment of a gas turbine according to the preferred embodiment of the present invention.
Figure 8:
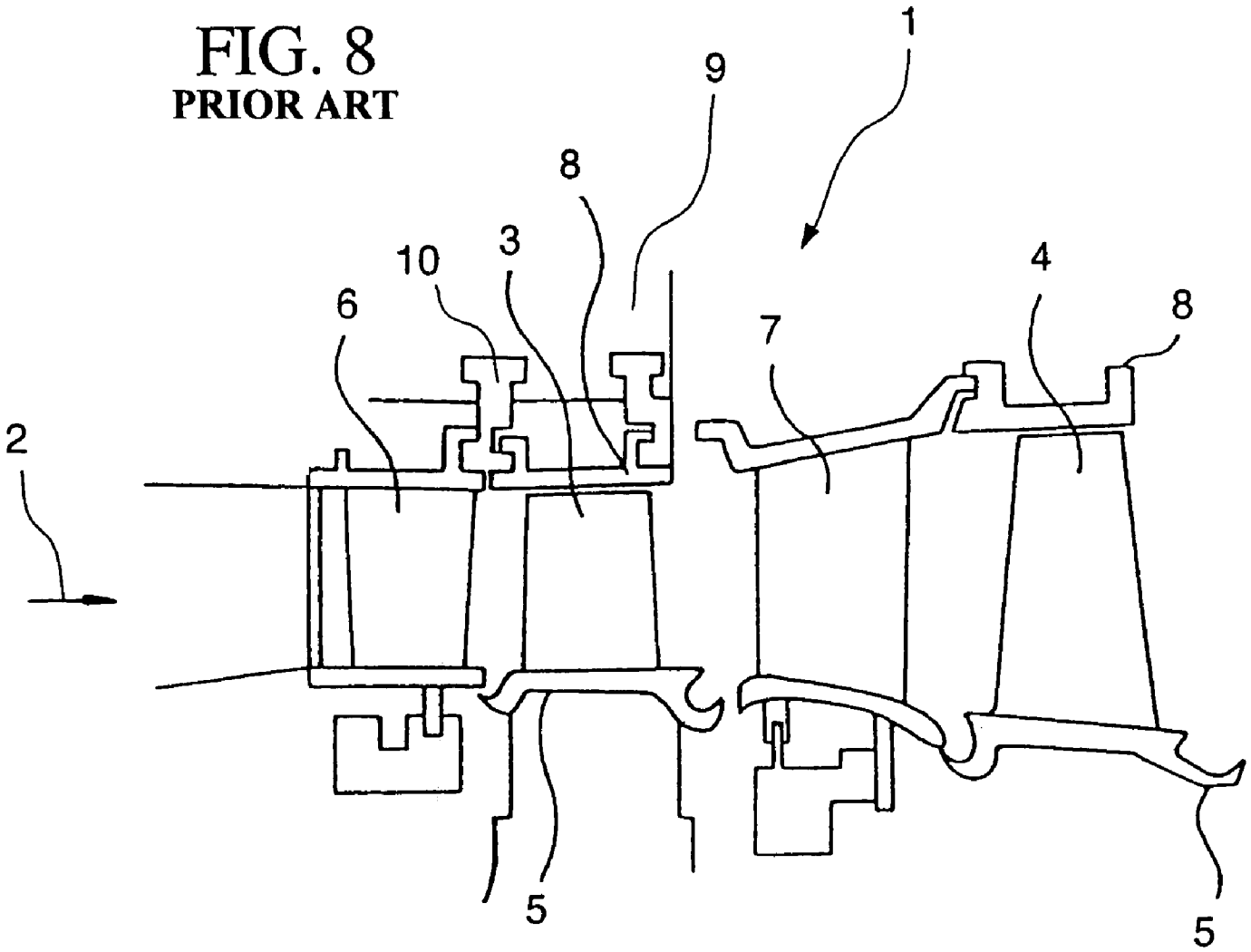
FIG. 8 PRIOR ART
FIG. 8 shows a portion of a gas turbine in section.
Figure 9:
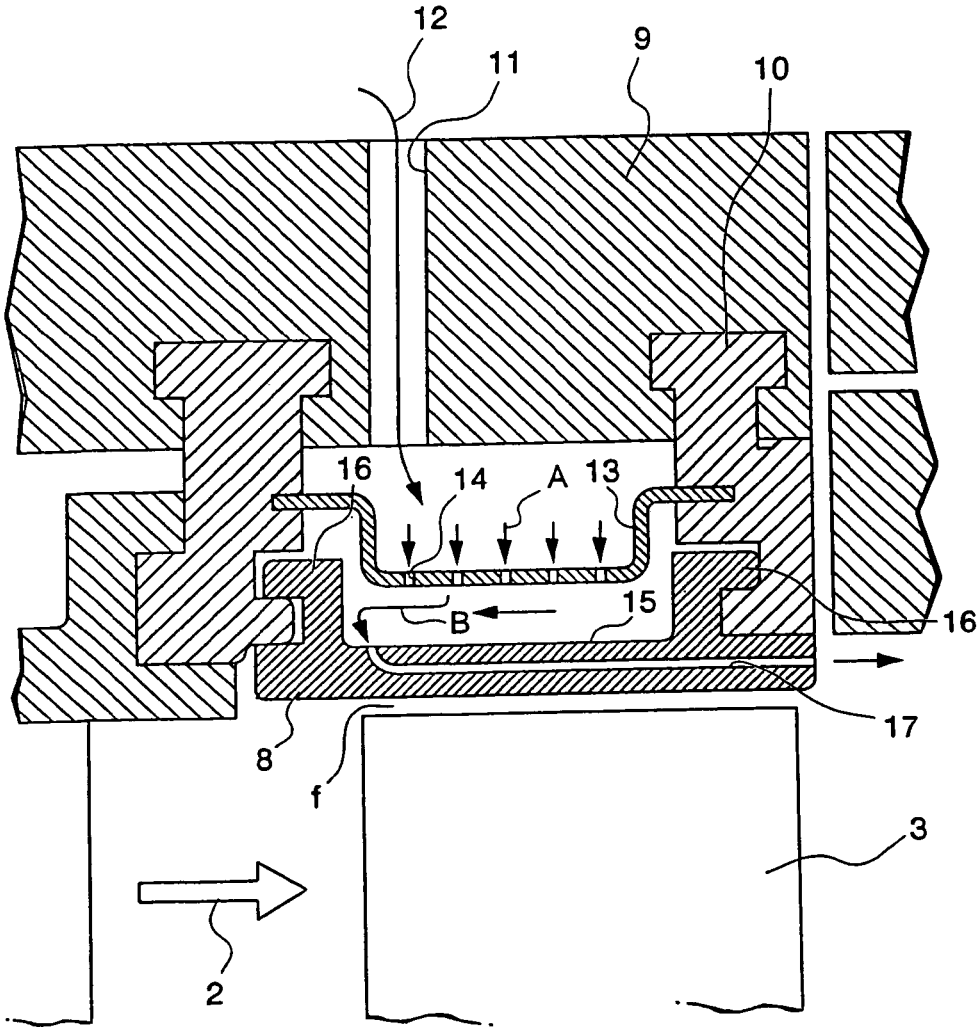
FIG. 9 PRIOR ART
FIG. 9 is a cross sectional view of a prior art ring segment, taken in a sectional plane similar to that of FIG. 8.
Figure 10:
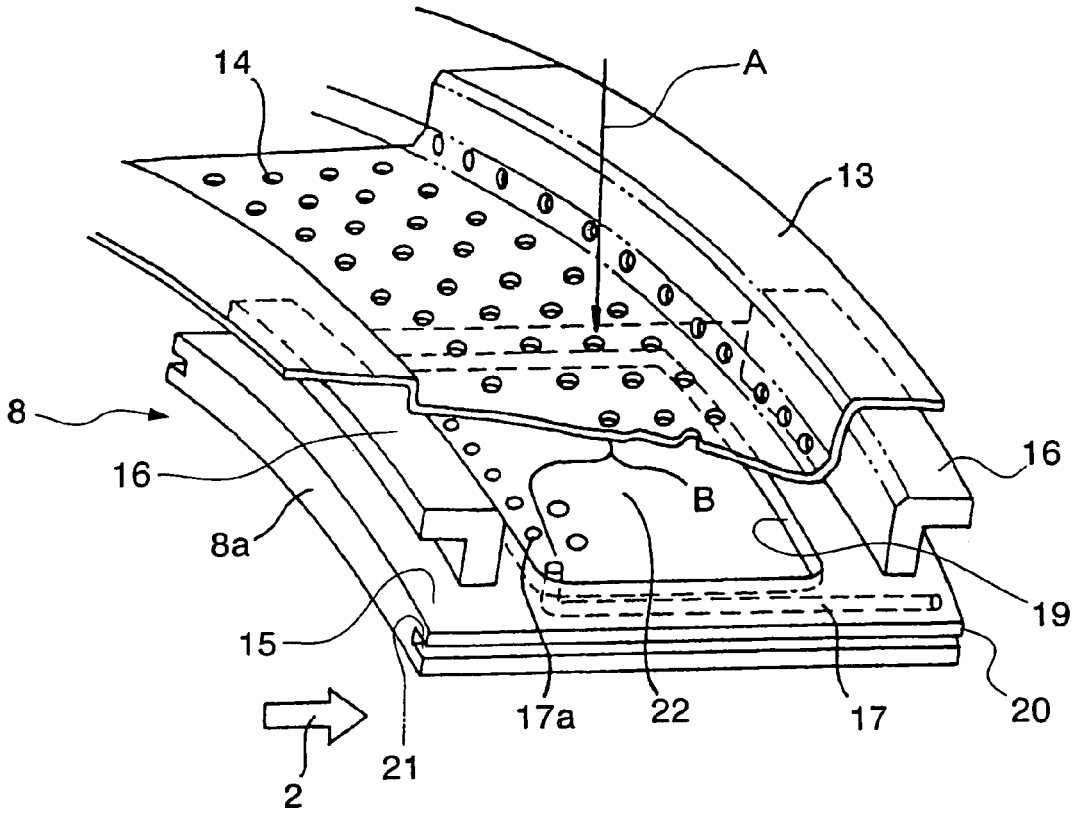
FIG. 10 PRIOR ART
FIG. 10 is a perspective view of an individual unit, a plurality of which together make up the prior art ring segment of FIG. 9.
Figure 11:
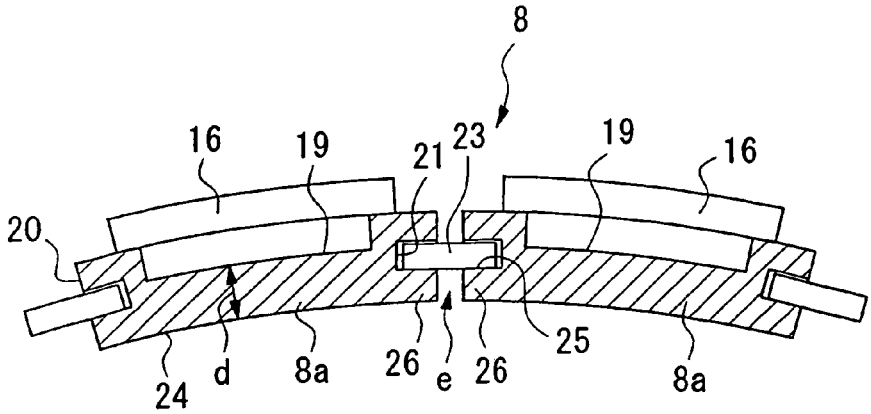
FIG. 11 PRIOR ART
FIG. 11 is a cross sectional view of a portion of this prior art ring segment as seen from the axial direction of the main shaft.

FIG. 7 is a cross sectional view along the direction of formation of the first cooling conduits 35, the second cooling conduits 37, and the third cooling conduits 59 and 60 which are formed in an individual unit 39. As shown in this figure, sixteen of these first cooling conduits 35 are provided, spaced apart from one another at equal intervals in the peripheral direction. And thirty-two of the second cooling conduits 37 are provided, spaced apart from one another at equal intervals in the peripheral direction. Moreover, sixteen of the third cooling conduits 60 are formed upon the side of the side edge 51. On the other hand, as for the third cooling conduits which are formed upon the side of the side edge 50, there are formed eight of the sucking in apertures 61 and thirty-two of the ejection apertures 62, and the flow conduits which face the sucking in apertures 61 and the flow conduits which face the ejection apertures 62 are connected together by a distribution conduit 65 which extends in the axial direction. Accordingly, after the air which flows in from the sucking in apertures 61 has been collected in the distribution conduit 65 which extends in the axial direction, it is divided from this distribution conduit 65 into the flow conduits which lead to the ejection apertures 62. Due to this, it is possible to cool the entire individual unit 39 evenly from its upstream side to its downstream side.

Next the flow of air while this gas turbine is operating will be explained.

Air which has been supplied from the blade ring 9 is blown against the outer peripheral surface 33 of the ring segment 30. This air which has thus been blown against the outer peripheral surface 33 flows along it both towards the upstream side and the downstream side and also in the peripheral direction, and cools the outer peripheral surface 33. At this time, this air performs cooling with high efficiency because its flow is made to be a turbulent flow by the projections 45 which are provided upon the outer peripheral surface 33.

The air which has flowed over the outer peripheral surface 33 towards the upstream side flows in to the sucking in apertures 47 of the first cooling conduits 35 from the direction shown by the arrow D, and flows towards the upstream side while cooling the individual unit 39, finally being ejected from the ejection apertures 46 which are formed in the end surface 34 on the upstream side in the direction of the arrow E. And the air which has flowed over the outer peripheral surface 33 towards the downstream side flows in to the sucking in apertures 49 of the second cooling conduits 37 from the direction shown by the arrow F, and flows towards the downstream side while cooling the individual unit 39, finally being ejected from the ejection apertures 46 which are formed in the end surface 36 on the downstream side in the direction of the arrow G.

Moreover, the air which has flowed over the outer peripheral surface 33 towards the side edge 50 flows in to the sucking in apertures 61 of the third cooling conduits 59, and flows in the peripheral direction while cooling this individual unit 39, finally being ejected (in the direction by the arrow H) from the ejection apertures 62 which are formed upon the beveled portion 56 of this individual unit 39 towards the opposing beveled portion 57 upon the adjacent individual unit 39 on this one circumferential side. Moreover, the air which has flowed over the outer peripheral surface 33 towards the other side edge 51 flows in to the sucking in apertures 63 of the other third cooling conduits 60, and flows in the peripheral direction while cooling this individual unit 39, finally being ejected (in the direction shown by the arrow I) from the ejection apertures 64 which are formed upon the beveled portion 57 of this individual unit 39 towards the opposing beveled portion 56 upon the adjacent individual unit 39 on this other circumferential side. The air which has been ejected from these ejection apertures 62 and 64 attempts to flow into the gap g (see FIG. 4), and thus flushes out the high temperature gas therein to the inside of the turbine.

According to the above described ring segment 30, the adjacent individual units 39 are joined together into a pair by the seal plate 53 and the joining together contact surfaces 54 and 55, and moreover, since a meandering conduit is defined between the adjacent individual units 39, the flow amount of air and high temperature gas leaking from between each pair of individual units 39 is reduced. Furthermore, since the lower surface of the seal plate 53 is not directly exposed to the high temperature gas, accordingly the seal plate 53 does not suffer damage. Yet further, since the side edges 50 and 51 and the edge portions of the inner peripheral surface 55, which in the prior art were locally at high temperature, are formed as the beveled portions 56 and 57, thereby their heat resistance is reduced so that their temperature is moderated. Moreover, the gaps g between the individual units 39 (the gaps between the ejection apertures 62 and 64) are made narrower as compared with the prior art, and accordingly the flow amount of the high temperature gas that is able to insinuate itself into these gaps g is reduced. Even further, since the air is ejected from the ejection apertures 62 and 64 which are provided in the beveled portions 56 and 57 into these gaps g, accordingly the high temperature gas is flushed out from these gaps g. Moreover, since the mutually confronting ejection apertures 62 and 64 are provided so as to alternate with one another in the axial direction, and do not directly point at one another, thereby the air streams which are ejected from these apertures 62 and 64 do not collide with one another, and these air streams are ejected smoothly, so that the high temperature gas is reliably flushed out from the gaps g. Accordingly, heating up of the beveled portions 56 and 57 is suppressed, and damage to these beveled portions 56 and 57 is prevented. Furthermore, since the above described ring segment 30 is made from nickel alloy, thereby high temperature oxidation of the ring segment 30 is prevented, and it is difficult for damage to the ring segment 30 to take place. Due to this, the flow amount of air and high temperature gas which leaks through between the individual units 39 is reduced, and thereby loss of the driving power of the gas turbine is suppressed.

Furthermore, with the above described ring segment 30, the air which is supplied from the outer peripheral surface 33 is ejected from both the upstream side and the downstream side, after having passed through the first cooling conduits 35 and the second cooling conduits 36. Accordingly the air flows smoothly upon the outer peripheral surface 33, and the efficiency of cooling of the outer peripheral surface 33 by the air is enhanced. This beneficial effect is also described in the publication "Gas Turbine Heat Transfer And Cooling Technology", which is published by Taylor and Francis Ltd. Furthermore, since the large number of small projections 45 are provided upon the outer peripheral surface 33, thereby the heating surface area of the outer peripheral surface 33 is increased. Yet further, the flow of air is made to be a turbulent flow by the projections 45, so that the heat exchange between the air and the outer peripheral surface 33 is improved. Accordingly, the outer peripheral surface 33 comes to be well cooled.

Since, with this ring segment 30, the thickness h (thickness of the main body portion) from the outer peripheral surface 33 which is cooled to the inner peripheral surface 55 is quite thin by comparison with the prior art, therefore the good cooling extends all the way to the inner peripheral surface 55, and the temperature difference between the inner and the outer peripheral surfaces of the ring segment 30 becomes small. Furthermore, with this ring segment 30, since the peripheral portion of the outer peripheral surface 33 against which no air blows is cooled by the flow of air through the first, second and third cooling conduits 34, 36, 59 and 60, thereby the temperature difference between the central portion and the circumferential portion of each of the individual units 39 becomes small. Accordingly, the mutual differences between the amounts of thermal expansion of each of the portions of the individual units 39 are reduced.

Furthermore, with the above described ring segment 30, thermal deformation of the ring segment 30 is suppressed, since the strength of each of the individual units 39 is enhanced by the provision of the separating ribs 42.

In this manner, with this ring segment 30, along with suppressing loss of the driving power of the gas turbine, contact between the ring segment 30 and the moving blades 3 and 4 is avoided, and it is possible to prevent deterioration of the performance of the gas turbine.

What is claimed is:

1. A ring segment of a gas turbine which comprises a blade ring, a main shaft and moving blades, comprising a plurality of individual units which define an annular form by being arranged around a peripheral direction of the main shaft, and disposed so that its inner peripheral surface is maintained at a constant distance from tips of the moving blades, each individual unit comprising:

grooves which extend along an axial direction of the main shaft, each groove facing a groove formed in an adjacent individual unit;

a seal plate for connecting together each adjacent pair of individual units, said seal plate being inserted into the grooves of adjacent units;

a convex side edge which is formed to be convex on a radially inward side of the seal plate so as to project a convex portion into a concave side edge of a first adjacent individual unit;

a concave side edge which is formed to be concave on the radially inward side of the seal plate so as to receive a convex side edge of a second adjacent individual unit;

contact surfaces defined on the radially inward side of the seal plate when the convex side edge of the individual unit and the concave side edge of the first adjacent individual unit are fitted together, beveled portions of the convex side edge and concave side edge on both radially inward peripheral side surfaces of said individual unit, each beveled portion facing a beveled portion of the adjacent individual unit, both beveled portions covered by a thermal barrier coating; and ejection apertures of a plurality of conduits including a first conduit which is open toward upstream, a second conduit which is open toward downstream, and a third conduit which is open toward the adjacent individual unit.

2. A ring segment of a gas turbine as described in claim 1, wherein a gap between each pair of individual units is greater than zero and less than or equal to 1 mm when the gas turbine is operating nominally.

3. A ring segment of a gas turbine as described in claim 1, wherein a thickness of a body of each of the individual units is greater than or equal to 1 mm and less than or equal to 4 mm.

4. A ring segment of a gas turbine as described in claim 1, wherein each individual unit comprises projections formed upon an outer peripheral surface thereof.

* * * * *